US011839266B2

(12) United States Patent
Reis

(10) Patent No.: US 11,839,266 B2
(45) Date of Patent: Dec. 12, 2023

(54) FOOTWEAR LACES AND METHOD FOR TIGHTENING FOOTWEAR LACES

(71) Applicant: BriTemp IP Holdco LLC, Dix Hills, NY (US)

(72) Inventor: Brian Reis, Chatham, NJ (US)

(73) Assignee: BriTemp IP Holdco LLC, Dix Hills, NY (US)

( * ) Notice: Subject to any disclaimer, the term of this patent is extended or adjusted under 35 U.S.C. 154(b) by 102 days.

(21) Appl. No.: 17/341,865

(22) Filed: Jun. 8, 2021

(65) Prior Publication Data

US 2021/0378362 A1 Dec. 9, 2021

Related U.S. Application Data

(60) Provisional application No. 63/036,199, filed on Jun. 8, 2020.

(51) Int. Cl.
*A43C 5/00* (2006.01)
*A43C 9/00* (2006.01)

(52) U.S. Cl.
CPC . *A43C 5/00* (2013.01); *A43C 9/00* (2013.01)

(58) Field of Classification Search
CPC .... A43C 5/00; A43C 9/00; A43C 9/02; A43C 1/00
See application file for complete search history.

(56) References Cited

U.S. PATENT DOCUMENTS 2,141,801 A * 12/1938 Taft ..... A43C 9/00 D2/978
3,906,642 A 9/1975 Cohen
4,017,984 A 4/1977 Bonfigli
(Continued)

FOREIGN PATENT DOCUMENTS

KR 10-2016-0142601 A 12/2016
WO 2013/051857 A1 4/2013
(Continued)

OTHER PUBLICATIONS

Easy Tie, May 17, 2014, 3 pp,, https://www.eastytieshoelaces.com/.
(Continued)

*Primary Examiner* — David M Upchurch
(74) *Attorney, Agent, or Firm* — KAPLAN BREYER SCHWARZ, LLP

(57) ABSTRACT

A lacing system is provided including a length of string, each string divided into a center region and a plurality of equal length regions. Each equal length region is designated by a color, pattern or indicia. The center region has a length equal to a distance between a bottom-most pair of left-side and right-side eyelets, the equal length regions each have a length equal to a diagonal distance between a left-side eyelet and a right-side eyelet. End lengths of each lace measure half the remainder of each lace remaining from the total length of the lace minus the summation of the center region plus the equal length regions. Each equal length region has a different color, pattern or indicia from its adjacent equal length region. Each of the end lengths has a different color, pattern or indicia from the equal length regions that is immediately adjacent to the end length.

7 Claims, 4 Drawing Sheets

(56) References Cited

U.S. PATENT DOCUMENTS

| | | | | |
|---|---|---|---|---|
| 4,247,967 | A * | 2/1981 | Swinton | A43C 1/00 24/713 |
| 4,842,522 | A | 6/1989 | Alexander et al. | |
| 5,110,296 | A | 5/1992 | Cohen | |
| 5,240,418 | A | 8/1993 | Silverman et al. | |
| 5,562,457 | A | 10/1996 | Haslam | |
| 5,611,692 | A | 3/1997 | Gehrdes | |
| 5,639,244 | A | 6/1997 | Stricklin | |
| 5,897,323 | A | 4/1999 | Stanfield | |
| 6,119,591 | A | 9/2000 | Chen | |
| D479,393 | S | 9/2003 | Weitzman | |
| 6,746,249 | B1 | 6/2004 | Claunch | |
| 6,968,638 | B2 | 11/2005 | Gonzalez Palacio | |
| 7,309,235 | B2 | 12/2007 | Wilk | |
| 9,743,715 | B1 | 8/2017 | Brekke-Jones | |
| 9,770,068 | B1 | 9/2017 | Aleshka et al. | |
| 2005/0260550 | A1* | 11/2005 | Wilk | G09B 19/0076 434/260 |
| 2012/0009554 | A1 | 1/2012 | Johnson | |
| 2013/0244213 | A1 | 9/2013 | Davis et al. | |
| 2014/0007392 | A1* | 1/2014 | Kajiwara | A43C 1/003 24/715.3 |
| 2014/0237781 | A1 | 8/2014 | Lee | |
| 2015/0237951 | A1 | 8/2015 | Hilderbrand, IV | |
| 2015/0257488 | A1* | 9/2015 | Flores | A43C 9/00 24/713 |
| 2016/0302529 | A1* | 10/2016 | Cogliandro | A43C 1/02 |

FOREIGN PATENT DOCUMENTS

| | | | |
|---|---|---|---|
| WO | 2016/162651 | A2 | 10/2016 |
| WO | 2018/163268 | A1 | 9/2018 |

OTHER PUBLICATIONS

JETEHO 4 Pairs 47 Inch Flat Rainbow Shoelaces Shoe Laces Colorful Sneakers Shoelaces for Adults, by JETEHO, Amazon webpage, 6 pp.

* cited by examiner

FOOTWEAR LACES AND METHOD FOR TIGHTENING FOOTWEAR LACES

CROSS-REFERENCE TO RELATED APPLICATION

This application claims priority to U.S. Provisional Patent Application Ser. No. 63/036,199, filed Jun. 8, 2020, entitled Skate Laces and Method for Tightening Skate Laces.

BACKGROUND OF THE INVENTION

The present invention is generally directed to lacing systems for footwear such as skates, boots and shoes. More particularly, the present invention is directed to improving a user's ability to adequately tighten laces on skates, shoes and boots such as hockey skates, ice skates and roller blades.

Laces on boots and large articles of footwear often are difficult to tighten. Boots are usually formed with a sole and an upper portion. The upper portion is usually made of a pliable material such as leather, plastic or canvas. The upper portion is usually formed with central opening. A tongue is formed on a lower end of the opening, the tongue extending between the sides of the opening. The sides of the opening are usually formed with eyelets through which a lace extends. The lace typically extends through the eyelets in a crisscross manner, going from side to side through the eyelets. Typically, the eyelets are formed on opposite sides of the opening in equal numbers at equally spaced apart intervals, defining pairs of eyelets.

When putting the boots on, the lower portions of the laces must typically be pulled tight near eyelets, separately from the tightening of the ends of the lace. For example, a large boot typically has seven or eight pairs of eyelets through which the lace extends. Often a boot user must pull portions of the lace near a second or third set of eyelets tight and then successively move up the pairs of eyelets, arab the corresponding portions of the lace and tighten it further until the top or ends of the lace are finally tightened. Such an operation is particularly difficult if the boot and lace are wet from prior usage of the boot, Whether the lace is wet or dry, the crisscross configuration of the lace and friction make it very difficult to tighten the lace easily.

When lacing footwear such as ice skates, hockey skates and roller blades or other articles with laces, it is imperative that the laces be sufficiently tightened with laces providing tight and even support around the foot and ankle. This is particularly true when lacing long tongued and high top ice skates and inline skates, where the lace is threaded through a large number of eyelets. Children are often the most common users of roller blades and ice skates, but often have great difficulty properly tightening the lace systems on these skates. Therefore, there exists a need to provide a lace system and a method of lacing to improve proper and independent lacing.

SUMMARY OF THE INVENTION

In a first exemplary embodiment of the present invention, a lacing system for a boot is provided where each boot has pairs of parallel and spaced apart left-side and right-side eyelets. The pairs of left-side and right-side eyelets extend from a toe of the boot to a top of the boot. The lacing system includes a lace for each boot where each lace includes an elongate length of string. Each string is divided into a center region at a center point of the length of the string and a plurality of regions, each region preferably but not necessarily equal length. Each of the equal length regions is designated by a color, pattern or indicia. The center region has a length approximately equal to a distance between a bottom-most pair of left-side and right-side eyelets of the boot. The equal length regions each have a length approximately equal to the diagonal distance between a left-side eyelet and a right-side eyelet at a single increment up the boot. End lengths of each lace at the end of each lace are included which measure half the remainder of each lace remaining from the total length of the lace minus the summation of the center region plus the equal length regions. Each of the equal length regions has a different color, pattern or indicia from its immediately adjacent equal length region. Each of the end lengths has a different color, pattern or indicia from one of the equal length regions that is immediately adjacent to the end length.

The equal length regions may include eight equal length regions and the eyelets may include eight pairs of eyelets.

A first exemplary method of tightening boot laces is also provided. The method begins with the step of providing a lacing system for use on a pair of boots, the boot having a plurality of parallel and spaced apart left-side and right-side eyelets. The pairs of left-side and right-side eyelets disposed in even increments from a toe of the boot to a top of the boot. The lacing system includes a lace for each boot. Each lace has an elongate length of string, where each string is divided into a center region at a longitudinal center of the string, and a plurality of equal length left side regions extending out from a left side of the center region, and a like plurality of equal length right side regions extending out from a right side of the central region. Each of the equal length regions is designated by a color, pattern or indicia. The center region has a length approximately equal to a distance between a bottom-most pair of left-side and right-side eyelets. Each equal length region has a length approximately equal to a diagonal distance between a left-side eyelet and a right-side eyelet at a single increment up the boot. Each of the equal length regions has a different color, pattern or indicia from its immediately adjacent equal length region. The color, pattern or indicia on the plurality of equal length right side regions and the ends of each lace are a mirror image of the color, pattern or indicia on the eight equal length left side regions and end lace, respectively.

The method continues with lacing the boots wherein the center region spans the first pair of left and right side eyelets, and the lace is threaded through the eyelets, in cross-wise fashion from the first pair of eyelets to the last pair of eyelets. Next, the lace is pulled until a first pair of equal length regions having a like color, pattern or indicia evenly appears between eyelets at the first increment. The method continues by continuing to pull on the lace until pairs of equal length regions having a like color, pattern or indicia evenly appear between each set of eyelets. The step of providing the lacing system may include providing a lace having two longer regions at the ends of each lace, wherein the longer regions are half the remainder of each lace remaining from the total length of the length of string minus the summation of the center region plus the equal length regions, and wherein the ends of each lace each have a different color, pattern or indicia from its immediately adjacent equal length region.

A second exemplary method of tightening boot laces is also provided. The method first includes the step of providing a lacing system for use on a pair of boots, where each boot has nine pairs of parallel and generally spaced apart left-side and right-side eyelets, including a first, a second, a third, a fourth, a fifth, a sixth, a seventh, an eighth pair and a ninth pair. The pairs of left-side and right-side eyelets are each disposed in eight generally even increments, including a first, a second, a third, a fourth, a fifth, a sixth, a seventh, and an eighth increment, from a toe of the boot to a top of the boot. The lacing system includes a lace for each boot. Each lace includes an elongate length of string. Each string is divided into a center region at a longitudinal center of the string, eight equal length left side regions extending out from a left side of the center region, and eight equal length right side regions extending out from a right side of the central region. Each of the equal length regions is designated by a color, pattern or indicia. Two longer regions are at the ends of each lace. The center region has a length approximately equal to a distance between a bottom-most pair of left-side and right-side eyelets. Each equal length region has a length approximately equal to a diagonal distance between a left-side eyelet and a right-side eyelet at a single increment up the boot. The longer regions at the end of each lace are half the remainder of each lace remaining from the elongate length of string minus the summation of the center region plus the equal length regions. Each of the equal length regions and the ends of each lace has a different color, pattern or indicia from its immediately adjacent equal length regions. The color, pattern or indicia on the eight equal length right side regions and the ends of each lace are a mirror image of the color, pattern or indicia on the eight equal length left side regions and end lace, respectively.

The method continues with the step of lacing the boots. The center region spans the first pair of left and right side eyelets. The lace is threaded through the eyelets in crosswise fashion from the first pair of eyelets to the ninth pair of eyelets. The lace is pulled until a first pair of equal length regions having a like color, pattern or indicia evenly appears between eyelets at the first increment. The method continues with the steps of pulling on the lace until a second pair of equal length regions having a like color, pattern or indicia evenly appears between eyelets at the second increment; pulling on the lace until a third pair of equal length regions having a like color, pattern or indicia evenly appears between eyelets at the third increment; pulling on the lace until a fourth pair of equal length regions having a like color, pattern or indicia evenly appears between eyelets at the fourth increment; pulling on the lace until a fifth pair of equal length regions having a like color, pattern or indicia evenly appears between eyelets at the fifth increment; pulling on the lace until a sixth pair of equal length regions having a like color, pattern or indicia evenly appears between eyelets at the sixth increment; pulling on the lace until a seventh pair of equal length regions having a like color, pattern or indicia evenly appears between eyelets at the seventh increment; and pulling on the lace until an eighth pair of equal length regions having a like color, pattern or indicia evenly appears between eyelets at the eighth increment.

DETAILED DESCRIPTION

For the purposes of the present invention, the term "eyelet" is intended to broadly include any type of annular attachment point commonly seen on footwear such as shoes and boots, including, but not limited to punched holes (with or without an accompanying metal grommet), webbed holes (i.e., small loops of fabric sewn into the upper of the footwear), D-rings, hooks, and the like, or any combination thereof.

For purposes of the present invention, the term "boot" is used to broadly describe substantially any type of laced footwear, including, for example, boots, shoes, hockey skates, ice skate, roller skates, inline skates, ski boots, and the like.

Figure 1:
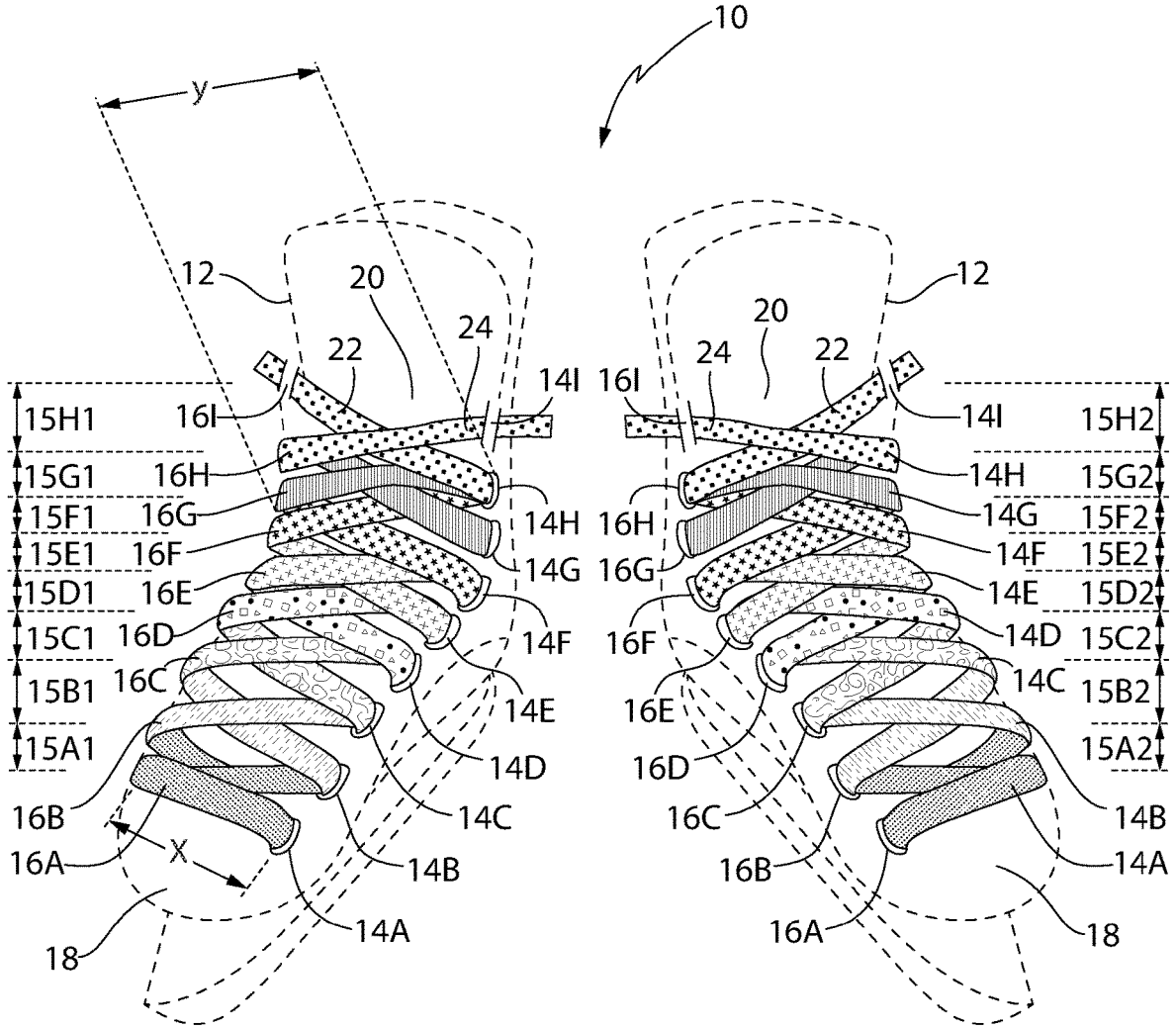
FIG. 1 is a front, perspective view of a pair of boots (e.g., ice hockey skates as shown here) having a lace system in accordance with an exemplary embodiment of the present invention.

Referring now to the drawing figures wherein like reference numbers refer to like elements throughout the several views, there is shown in FIG. 1 a lacing system 10 adopted for a pair of boots 12 in accordance with an exemplary embodiment of the present invention.

The boots 12 have a plurality of pairs (for example, nine pairs) of parallel and generally spaced apart left-side eyelets, (for example, eyelets 14A-14I), a plurality of matching right-side eyelets (for example, eyelets 16A-16I). The pairs of left-side 14A-14I and right-side eyelets 16A-16I are disposed in generally even increments 15A1-15H1 and 15A2-15H2 from a toe 18 of the boot 12 to a top 20 of the boot 12. The lacing system 10 includes a lace 22 for each boot 22.

Figure 2:
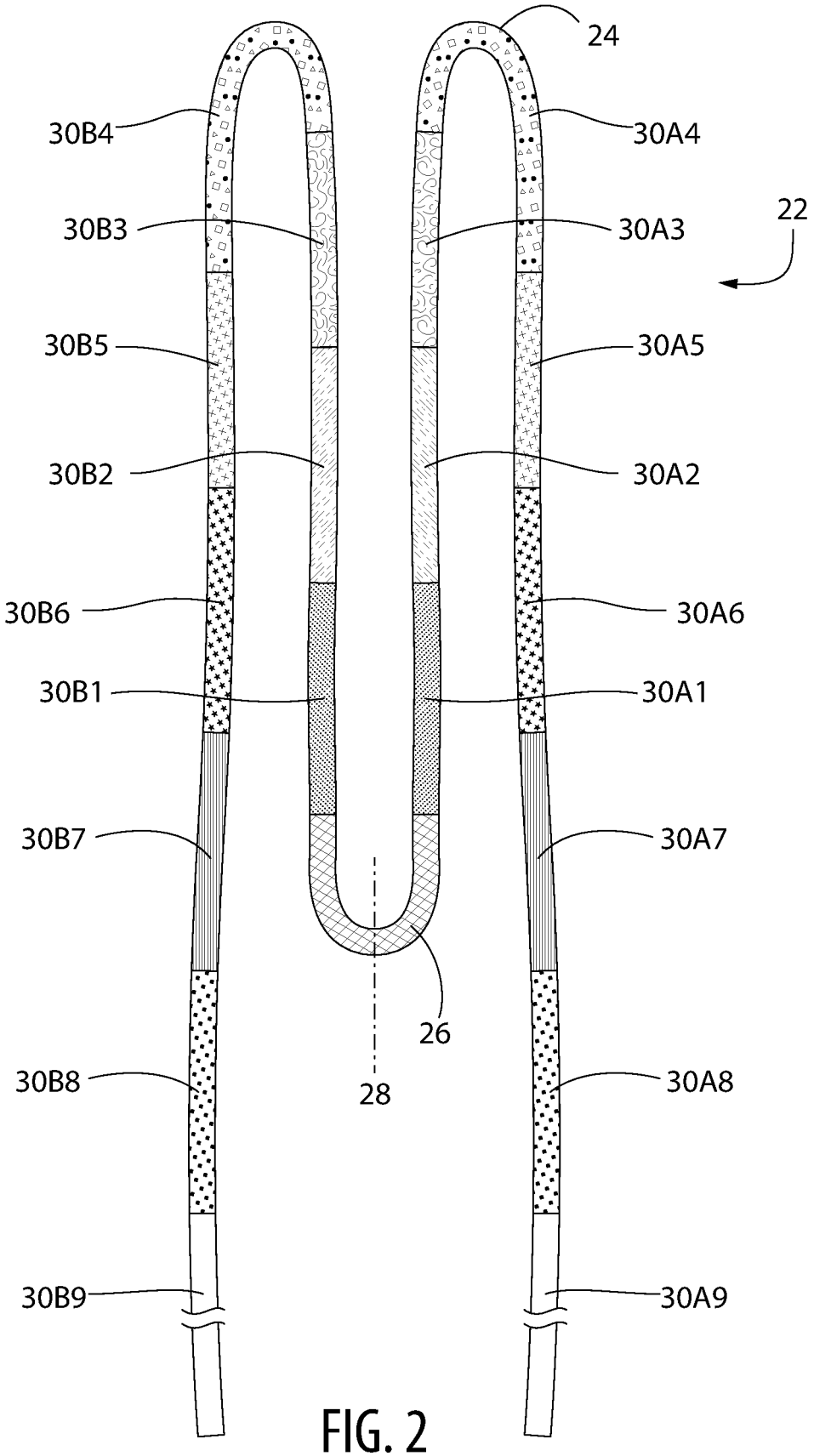
FIG. 2 is a simplified top view of a lace of FIG. 1.
Figure 3:
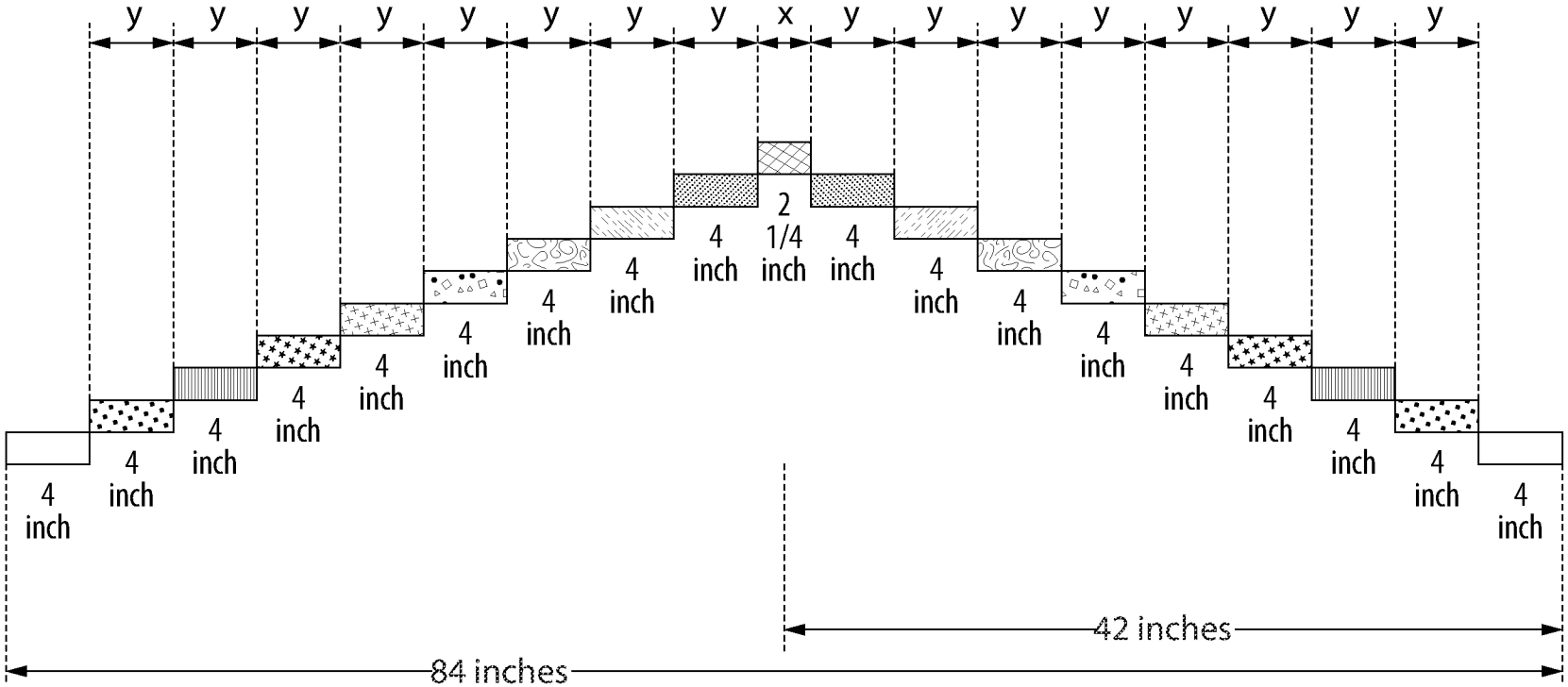
FIG. 3 is a schematic view of an exemplary lace of the lace system in accordance with the present invention.

As can be seen in FIG. 2 and in the schematic of FIG. 3, each lace 22 is an elongate length of string 24. Each string 24 is divided into a center region 26 at a longitudinal center 28 of the string 24 and a plurality of equal length regions (for example, eight regions 30A1, 30A2, 30A3, 30A4, 30A5, 30A6, 30A7, 30A8 on one side of the center region 36 and eight regions, 30B1, 30B2, 30B3, 30B4, 30B5, 30B6, 30B7, 30B8 on the other side of the center region 26), and longer regions at the end of each lace 30A9 and 30B9. Each of the equal length regions is designated by a color, pattern or indicia (see FIGS. 1-3). The center region 26 has a length X approximately equal to a distance between a bottom-most pair of left-side 14A and right-side eyelets, loops or hooks 16A. Each equal length region 30A1-30A8 and 30B1-30B8 has a length approximately equal to a diagonal distance Y between a left-side eyelet and a right-side eyelet at a single increment up the boot (for example, the distance between eyelets 16G and 14H (see FIGS. 1 and 3;). The longer regions at the end of each lace are half the remainder of each lace remaining from the total length of the lace minus the summation of the center region plus the equal length regions. Each of the equal length regions 30A1-30A8, 30B1-30B8 has a different color, pattern or indicia from its immediately adjacent equal length regions as shown in FIGS. 1-3, as does the longer regions 30A9, 30B9 at the end of each lace. There may be as many as eight different colors, patterns or indicia for each pair of equal length regions (e.g., red 30A1 and 30B1, 30A2 and 30B2, etc.), or just two different colors, patterns or indicia for each pair, so long as no adjacent pairs are the same color, pattern or indicia.

A typical boot 12, such as the boot shown, here may have a lace 22 that is approximately 84 inches long, but the present invention is intended to accommodate substantially any lace length. For the 84 inch lace 22 of the present example, the center region 26 may be approximately 2¼ inches long and each equal length region 30A1-30A8 and 30B1-30B8 is approximately 4 inches long. See FIG. 3. The longer regions at the end of each lace are approximately 8¾ inches in length each. In this exemplary embodiment, the color, pattern or indicia on the eight equal length left side regions 30A1-30A8 are a mirror image of the color, pattern or indicia on the eight equal length right side regions 30B1-30B8, and the longer length regions are identical in color but different than region immediately preceding.

Figure 4A:
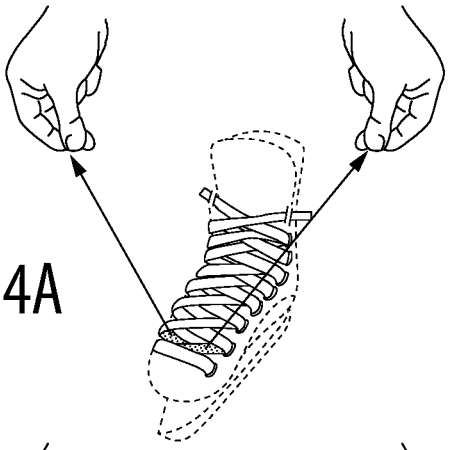
FIGS. 4A, 4B, 4C, 4D, 4E, 4F, 4G and 4H are a series of perspective views showing the method of tightening laces in accordance with an exemplary embodiment of the present invention.
Figure 4B:
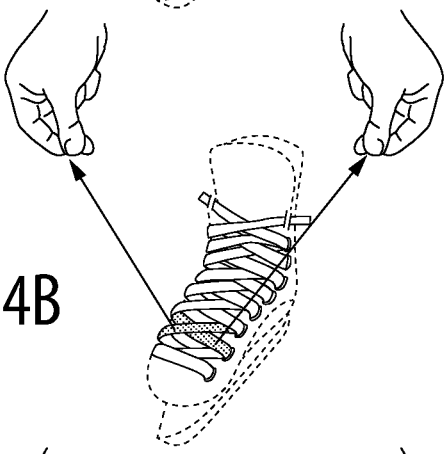
Figure 4C:
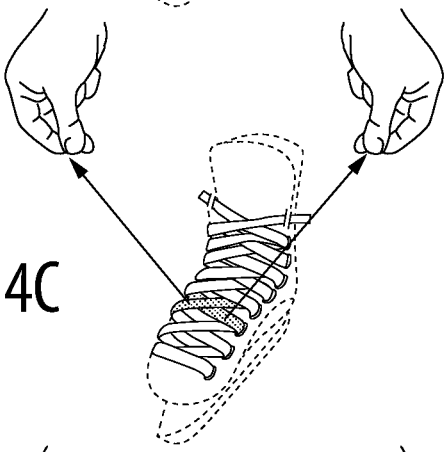
Figure 4D:
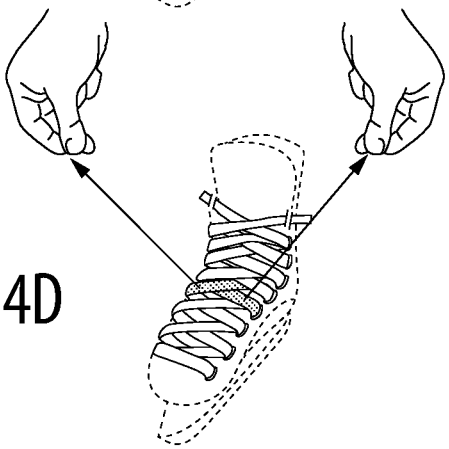
Figure 4E:
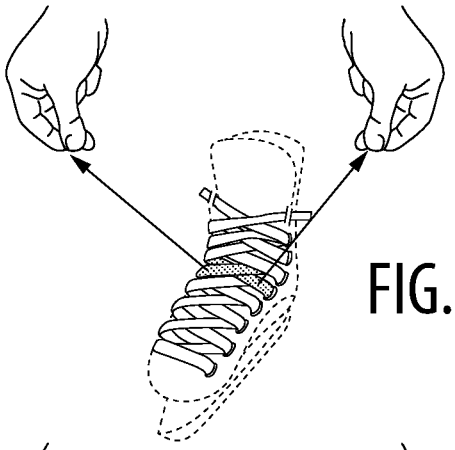
Figure 4F:
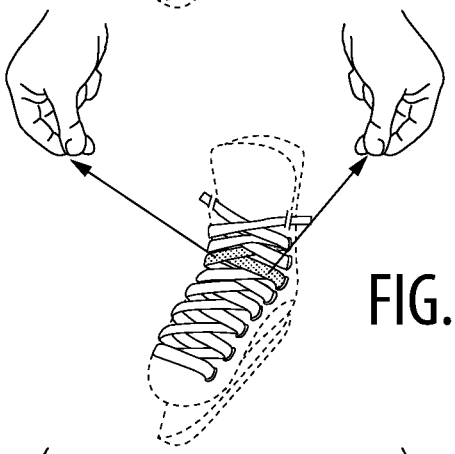

As can best be seen in FIGS. 4A-4H, A method of tightening boot laces is also provided utilizing the lacing system 10 described above. The steps are as follows:

The boot is first laced in a commonly known fashion such that the center region 26 spans the first pair of left and right side eyelets, and the lace is threaded through the eyelets in cross-wise fashion from the first pair of eyelets to the eighth pair of eyelets;

A first pair of equal length regions 30A1, 30B1 having a like color, pattern or indicia is pulled until a like color, pattern or indicia evenly appears between eyelets at the first increment (See FIG. 4A);

A second pair of equal length regions 30A2, 30B2 having a like color, pattern or indicia is pulled until a like color, pattern or indicia evenly appears between eyelets at the second increment (See FIG. 4B);

A third pair of equal length regions 30A3, 30B3 having a like color, pattern or indicia is pulled until a like color, pattern or indicia evenly appears between eyelets at the third increment (See FIG. 4C);

A fourth pair of equal length regions 30A4, 30B4 having a like color, pattern or indicia is pulled until a like color, pattern or indicia evenly appears between eyelets at the fourth increment (See FIG. 4D);

A fifth pair of equal length regions 30A5, 30B5 having a like color, pattern or indicia is pulled until a like color, pattern or indicia evenly appears between eyelets at the fifth increment (See FIG. 4E);

A sixth pair of equal length regions 30A6, 30B6 having a like color, pattern or indicia is pulled until a like color, pattern or indicia evenly appears between eyelets at the sixth increment (See FIG. 4F).

Figure 4G:
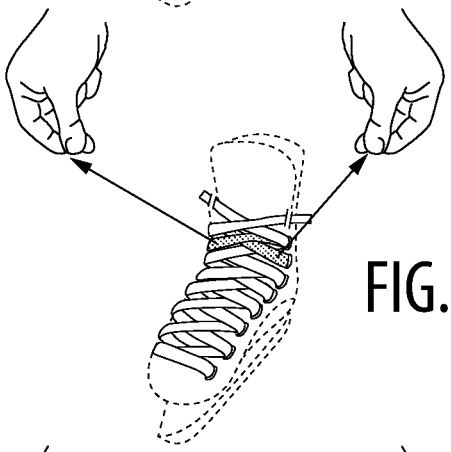

A seventh pair of equal length regions 30A7, 30B7 having a like color, pattern or indicia is then pulled until a like color, pattern or indicia evenly appears between eyelets at the seventh increment (see FIG. 4G).

Figure 4H:
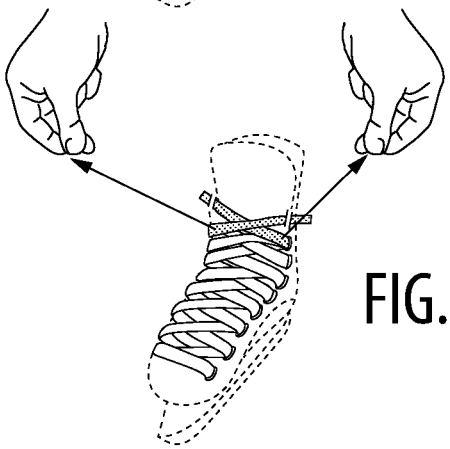

An eighth pair of equal length regions 30A8, 30B8 having a like color, pattern or indicia is then pulled until a like color, pattern or indicia evenly appears between eyelets at the eighth increment (see FIG. 4H)

A knot is then placed at the top 20 of the boot 12 (not shown).

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. A lacing system for a boot, each boot having a plurality of pairs of parallel and spaced apart left-side and right-side eyelets, the pairs of left-side and right-side eyelets from a toe of the boot to a top of the boot, the lacing system comprising a lace for each boot, each lace comprising:

an elongate length of string, each string divided into a center region at a center point of the length of the string and a plurality of equal length regions, each of the equal length regions designated by a color, pattern or indicia, the center region having a length approximately equal to a distance between a bottom-most pair of left-side and right-side eyelets of the boot, the equal length regions each having a length approximately equal to a diagonal distance between a left-side eyelet and a right-side eyelet at a single increment up the boot, and end lengths of each lace at the end of each lace which measure half the remainder of each lace remaining from the total length of the lace minus the summation of the length of the center region plus the length of the equal length regions;

wherein each of the equal length regions has a different color, pattern or indicia from immediately adjacent equal length regions; and wherein each of the end lengths has a different color, pattern or indicia from one of the equal length regions that is immediately adjacent to the end length.

2. The lacing system for a boot of claim 1, wherein the plurality of equal length regions are eight equal length regions and the plurality of pairs of eyelets are eight pairs of eyelets.

3. A lacing system for a boot, each boot having a plurality of pairs of parallel and spaced apart left-side and right-side eyelets, the pairs of left-side and right-side eyelets from a toe of the boot to a top of the boot, the lacing system comprising a lace for each boot, each lace comprising:

an elongate length of string, each string divided into a center region at a center point of the length of the string and a plurality of regions, each of the regions designated by a color, pattern or indicia, the center region having a length approximately equal to a distance between a bottom-most pair of left-side and right-side eyelets of the boot, the regions each having a length approximately equal to diagonal distances between a left-side eyelet and a right-side eyelet at a single increment up the boot, and end lengths of each lace at the end of each lace which measure half the remainder of each lace remaining from the total length of the lace minus the summation of the length of the center region plus the length of the regions;

wherein each of the regions has a different color, pattern or indicia from immediately adjacent regions; and wherein each of the end lengths has a different color, pattern or indicia from one of the regions that is immediately adjacent to the end length.

4. The lacing system for a boot of claim 3, wherein the plurality of regions are eight regions and the plurality of pairs of eyelets are eight pairs of eyelets.

5. A method of tightening boot laces, comprising:

(a) providing a lacing system for use on a pair of boots, the boot having a plurality of parallel and spaced apart left-side and right-side eyelets, the pairs of left-side and right-side eyelets disposed in even increments from a toe of the boot to a top of the boot, the lacing system comprising a lace for each boot, each lace comprising:

(i) an elongate length of string, each string divided into a center region at a longitudinal center of the string, and a plurality of equal length left side regions extending out from a left side of the center region, and a like plurality of equal length right side regions extending out from a right side of the central region, each of the equal length regions designated by a color, pattern or indicia, the center region having a length approximately equal to a distance between a bottom-most pair of left-side and right-side eyelets, each equal length region having a length approximately equal to a diagonal distance between a left-side eyelet and a right-side eyelet at a single increment up the boot;

(ii) wherein, each of the equal length regions have a different color, pattern or indicia from immediately adjacent equal length regions; and (iii) wherein the color, pattern or indicia on the plurality of equal length right side regions and the ends of each lace are a mirror image of the color, pattern or indicia on the eight equal length left side regions and end lace, respectively;

(b) lacing the boots wherein:

(i) the center region spans the first pair of left and right side eyelets, and (ii) the lace is threaded through the eyelets, in crosswise fashion from the first pair of eyelets to the last pair of eyelets;

(c) pulling the lace until a first pair of equal length regions having a like color, pattern or indicia evenly appears between eyelets at the first increment; and (d) continuing to pull on the lace until pairs of equal length regions having a like color, pattern or indicia evenly appear between each set of eyelets.

6. The method of tightening boot laces of claim 5, wherein the step of providing the lacing system includes providing a lace having two longer regions at the ends of each lace, wherein the longer regions are half the remainder of each lace remaining from the total length of the length of string minus the summation of the length of the center region plus the length of the equal length regions, wherein the ends of each lace each have a different color, pattern or indicia from immediately adjacent equal length regions.

7. A method of tightening boot laces, comprising:

(a) providing a lacing system for use on a pair of boots, each boot having nine pairs of parallel and generally spaced apart left-side and right-side eyelets, including a first, a second, a third, a fourth, a fifth, a sixth, a seventh, an eighth pair and a ninth pair, the pairs of left-side and right-side eyelets disposed in eight generally even increments, including a first, a second, a third, a fourth, a fifth, a sixth a seventh, and an eighth increment, from a toe of the boot to a top of the boot, the lacing system comprising a lace for each boot, each lace comprising:

(i) an elongate length of string, each string divided into a center region at a longitudinal center of the string, eight equal length left side regions extending out from a left side of the center region, and eight equal length right side regions extending out from a right side of the central region, each of the equal length regions designated by a color, pattern or indicia, and two longer regions at the ends of each lace, the center region having a length approximately equal to a distance between a bottom-most pair of left-side and right-side eyelets, each equal length region having a length approximately equal to a diagonal distance between a left-side eyelet and a right-side eyelet at a single increment up the boot, and the longer regions at the end of each lace are half the remainder of each lace remaining from the elongate length of string minus the summation of the length of the center region plus the length of the equal length regions;

(ii) wherein, each of the equal length regions and the ends of each lace has a different color, pattern or indicia from immediately adjacent equal length regions; and (iii) wherein the color, pattern or indicia on the eight equal length right side regions and the ends of each lace are a mirror image of the color, pattern or indicia on the eight equal length left side regions and end lace, respectively;

(b) lacing the boots wherein:

(i) the center region spans the first pair of left and right side eyelets; and (ii) the lace is threaded through the eyelets in crosswise fashion from the first pair of eyelets to the ninth pair of eyelets;

(c) pulling on the lace until a first pair of equal length regions having a like color, pattern or indicia evenly appears between eyelets at the first increment;

(d) pulling on the lace until a second pair of equal length regions having a like color, pattern or indicia evenly appears between eyelets at the second increment;

(e) pulling on the lace until a third pair of equal length regions having a like color, pattern or indicia evenly appears between eyelets at the third increment;

(f) pulling on the lace until a fourth pair of equal length regions having a like color, pattern or indicia evenly appears between eyelets at the fourth increment;

(g) pulling on the lace until a fifth pair of equal length regions having a like color, pattern or indicia evenly appears between eyelets at the fifth increment;

(h) pulling on the lace until a sixth pair of equal length regions having a like color, pattern or indicia evenly appears between eyelets at the sixth increment;

(i) pulling on the lace until a seventh pair of equal length regions having a like color, pattern or indicia evenly appears between eyelets at the seventh increment; and (j) pulling on the lace until an eighth pair of equal length regions having a like color, pattern or indicia evenly appears between eyelets at the eighth increment.

* * * * *